US005574546A

United States Patent [19]

Kumasaka et al.

[11] Patent Number: 5,574,546

[45] Date of Patent: Nov. 12, 1996

[54] DEVELOPING APPARATUS FOR AN ELECTROPHOTOGRAPHIC MACHINE

[75] Inventors: Takao Kumasaka, Takahagi; Yasuo Takuma, Hitachi; Tatsuo Igawa, Kitaibaraki; Tomio Sugaya; Yasuo Kikuchi, both of Hitachinaka, all of Japan

[73] Assignees: Hitachi, Ltd.; Hitachi Koki Co., Ltd., both of Tokyo, Japan

[21] Appl. No.: 504,314

[22] Filed: Jul. 20, 1995

[30] Foreign Application Priority Data

Jul. 22, 1994 [JP] Japan ..... 6-170555

[51] Int. Cl.[6] ..... G03G 15/00

[52] U.S. Cl. ..... 399/276

[58] Field of Search ..... 355/251, 253, 355/245, 246, 259; 118/656, 657, 658; 430/122

[56] References Cited

U.S. PATENT DOCUMENTS

| | | | |
|---|---|---|---|
| 4,354,454 | 10/1982 | Nishikawa | 118/658 |
| 4,498,755 | 2/1985 | Ohkubo et al. | 118/658 |
| 4,679,527 | 7/1987 | Chang | 118/658 |
| 4,780,741 | 10/1988 | Wada et al. | 118/653 |
| 4,799,086 | 1/1989 | Mori | 118/657 |
| 4,901,116 | 2/1990 | Haneda et al. | 355/253 |
| 4,941,019 | 7/1990 | Honda et al. | 355/251 |
| 5,385,801 | 1/1995 | Terasaka et al. | 430/122 |
| 5,402,215 | 3/1995 | Yamaji | 355/251 |
| 5,469,245 | 11/1995 | Aoshima et al. | 355/251 |

FOREIGN PATENT DOCUMENTS

| | | |
|---|---|---|
| 55-101969 | 8/1980 | Japan . |
| 60-168177 | 8/1985 | Japan . |
| 61-198170 | 9/1986 | Japan . |
| 3-109582 | 5/1991 | Japan . |
| 3-291680 | 12/1991 | Japan . |
| 4-338781 | 11/1992 | Japan . |

*Primary Examiner*—Thu Anh Dang

*Attorney, Agent, or Firm*—Antonelli, Terry, Stout & Kraus

[57] ABSTRACT

A developing apparatus in which a stationary multipole permanent magnet is placed in a sleeve and in which development is performed by bringing a developer, which contains at least carrier and toner particles and is held on the periphery of a sleeve by use of the magnetic force of the multipole permanent magnet, into contact with a photo-conductive body owing to the rotation of the sleeve. For securing image density and for preventing the deposition of carrier onto the photo-conductive body, two magnetic pieces, each of which is arranged lengthwise in the direction of the axis thereof and which have the same polarity, are placed in a region in the multipole permanent magnet which faces the photo-conductive body in such a manner as to adjoin in the circumferential direction of said permanent magnet. This results in generation of the distribution of a magnetic field which has two peaks of magnetic force. The position at which the second one of the two peaks of the magnetic force is formed, downstream in the direction of rotation of the sleeve, is set at the nearest point between the photo-conductive body and the sleeve. Thereby, even when development is performed by bringing the developer into light contact with the photo-conductive body, the image density can be secured. Further, the carrier can be prevented from depositing on the photo-conductive body.

22 Claims, 3 Drawing Sheets

DEVELOPING APPARATUS FOR AN ELECTROPHOTOGRAPHIC MACHINE

BACKGROUND OF THE INVENTION

1. Field of the Invention

The present invention relates to a developing apparatus for use in electrophotographic or xerographic equipments such as a copying machine, a printer or a facsimile system.

2. Description of the Related Art

FIG. 6 illustrates an example of a conventional developing apparatus which uses a dual component developer containing carrier and toner particles. The conventional developing apparatus 2 of this figure is comprised of a vessel (or casing) 30 which incorporates a developing roller 5 and contains a developer, a regulating plate 6 placed in parallel with the axis of rotation of the developing roller 5 at a predetermined distance from the circumferential surface of the developing roller 5, an agitating roller 10 which is similarly incorporated in the vessel 30 and is operative to agitate the developer contained in the vessel 30, a toner hopper 21 which is fixedly supported in the vessel 30 and stores toner particles therein, a supplying roller 22 which is provided in the toner hopper 21 and is operative to supply toner into the vessel 30, a cylindrical photo-conductive body (namely, photoconductor) 1 placed in such a manner as to have the axis of rotation thereof parallel to the axis of rotation of the developing roller 5, and a means or device (not shown) for forming an electrostatic latent image along the surface of the photo-conductive body 1.

The developing roller 5 facing the photo-conductive body 1, the axis of rotation of which is parallel with that of the roller 5, is constructed by fixedly placing a cylindrical multipole permanent magnet 4 in a rotatable developing sleeve 3. A plurality of magnetic poles S, N, S, N, . . . are provided on a peripheral portion of the multipole permanent magnet 4. Further, a developing magnetic pole portion (namely, double magnetic poles having the same polarity) 8 is provided in another portion of the multipole permanent magnet 4 to face the photo-conductive body 1.

In the case of this developing apparatus, the dual component developer 7 containing carrier and toner particles is attracted by the force of attraction of the multipole permanent magnet 4 and is then held on the periphery of the sleeve 3. This developer is carried by the rotation in the direction of an arrow A (namely, the counterclockwise direction as viewed in this figure) of the sleeve 3. When this developer passes through the gap between the regulating plate 6 and the sleeve 3, superfluous developer, namely, an outer layer of the developer outside the inner layer thereof, whose thickness is equal to the width of the gap, held on the periphery of the sleeve 3, is scraped away therefrom. Thus, developer of uniform thickness, which is deposited on the periphery of the sleeve 3, is carried to the developing magnetic pole portion 8. In this developing magnetic pole portion 8, the developer 7 forms a magnetic brush along lines of magnetic force and further, a toner image is formed on the surface of the photo-conductive body 1 by bringing the developer 7 into contact with the electrostatic latent image formed on the photo-conductive body 1 which rotates in the direction of an arrow B (namely, clockwise, as viewed in this figure). Furthermore, the toner is consumed in the development. Therefore, the vessel 30 is replenished with toner particles through the supplying roller 22 from the toner hopper 21, if necessary.

Moreover, in order to increase the developability in the developing magnetic pole portion 8, there has been proposed a method by which the developing magnetic pole portion 8 is constituted by two adjoining magnetic poles, namely, double magnetic poles having the same polarity. In the space between such double magnetic poles, the constraint on the developer 7 due to magnetic force (namely, magnetic field strength) is removed owing to the presence of a repulsive magnetic field. Thus the developer 7 comes to easily move to the photo-conductive body. Consequently, the developability can be increased even in the case where there is soft contact between the developer and the photo-conductive body. Such developing methods with double magnetic poles are disclosed in, for example, the Japanese Patent Public Disclosure Official Gazettes Nos. 55-101969/1980, 3-291680/1991 and 4-338781/1992. Moreover, there have been proposed other methods such as a method using AC bias to increase image density (see the Japanese Patent Public Disclosure Official Gazettes Nos. 61-198170/1986, 60-168177/1985 and 3-109582/1991).

The aforementioned developing apparatus, however, has the following propensity. Namely, when using carrier particles having small magnetizing force or those of small diameters in order to obtain a sober contact between the developer 7 and the photo-conductive body 1 and secure uniform print quality, the force of constraint of the developer due to the developing magnetic pole is weakened so that carrier particles come to deposit on the photo-conductive body 1 and the print quality is deteriorated. Besides, in the aforementioned Official Gazettes concerning the developing method with double magnetic poles, for instance, the Japanese Patent Public Disclosure Official Gazette No. 55-101969/1980, there is illustrated an example in which two peaks of magnetic field occur in the developing magnetic pole portion. This Official Gazette, however, makes no mention of the relation between the developing point at which the distance from the developing roller to the photo-conductive body becomes minimum and the distribution of magnetic field having two peaks thereof.

SUMMARY OF THE INVENTION

Accordingly, a first object of the present invention is to provide a developing apparatus which is able to prevent carrier particles from depositing on a photo-conductive body in the case of performing a developing method with double magnetic poles, and to secure high print quality.

Further, a second object of the present invention is to provide a color electrophotographic system which can prevent a toner image formed in a preceding stage from being disturbed when forming the toner image of a plurality of colors on a photo-conductive body and performing color printing, and which can secure image densities respectively corresponding to second and subsequent colors and can prevent carrier particles from depositing on a photo-conductive body when performing developing of second or subsequent colors.

To achieve the foregoing objects, in accordance with the present invention, there is provided a developing apparatus wherein a multipole permanent magnet is fixedly placed in a sleeve, wherein a developer is attracted and held on the periphery of the sleeve by the magnetic force of the multipole permanent magnet, wherein the rotation of the sleeve brings the developer, which is held on the periphery of the sleeve, into contact with the circumferential surface of a cylindrical photo-conductive body rotating around the axis of rotation thereof, which is parallel with the axis of rotation of the sleeve, to thereby develop an electrostatic latent image formed on the surface of the photo-conductive body. In this developing apparatus, first and second magnetic pieces (or tips) having same polarity are placed in a region of the multipole permanent magnet, which faces the photo-conductive body, in such a manner as to adjoin in the circumferential direction of the multipole permanent magnet.

Thereby, the distribution of the magnetic field whose strength (or intensity) has two peaks, namely, first and second peaks in a section transverse the axis of rotation of the sleeve. The second magnetic piece is positioned at a place where the second peak of the strength of the magnetic field, which is located downstream of the first peak in the direction of rotation of the sleeve, is formed at almost the nearest point of the sleeve, at which the sleeve becomes almost nearest to the photo-conductive body.

In the case of the developing apparatus of the present invention, the second magnetic piece, for forming the second peak of the strength of the magnetic field, is placed at a position on the stationary multipole permanent magnet in such a manner that the second peak of the strength of the magnetic field is formed at almost the nearest point where the photo-conductive body becomes almost nearest or closest to the sleeve. Thereby, the developer being present in the proximity of the surface of the photo-conductive body located at almost the nearest point is attracted toward the developing roller by the action of the magnetic force corresponding to the second peak. Thus, the carrier particles do not deposit on the photo-conductive body at all. Further, when the developer held by the magnetic force of the first magnetic piece is moved between the double magnetic poles having same magnetic polarity as the sleeves rotates, a toner cloud is formed in the vicinity of the second peak of the strength of the magnetic field by agitation caused owing to a decrease in magnetic force applied to the developer. Thus, the toner is easy to deposit on the photo-conductive body. Consequently, an electrostatic latent image formed on the photo-conductive body can be developed at high densities.

BRIEF DESCRIPTION OF THE DRAWINGS

Other features, objects and advantages of the present invention will become apparent from the following description of preferred embodiments with reference to the drawings in which like reference characters designate like or corresponding parts throughout the several views, and in which.

DETAILED DESCRIPTION OF THE PREFERRED EMBODIMENTS

Hereinafter, the preferred embodiments of the present invention will be described in detail by referring to the accompanying drawings.

(1) First Embodiment

Figure 1:
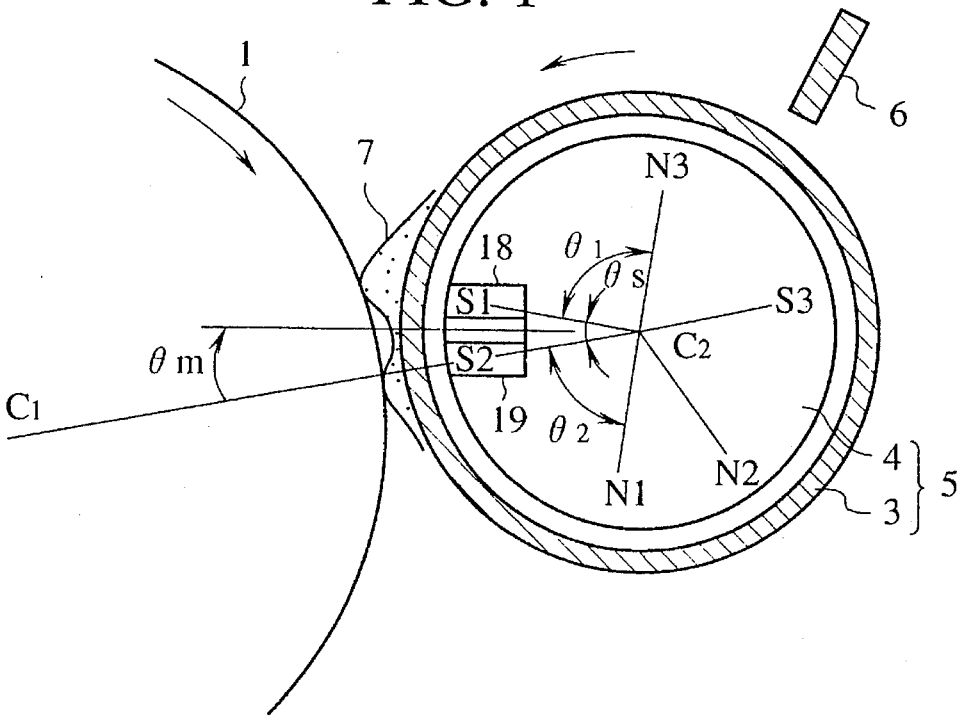
FIG. 1 is a sectional view of a developing apparatus embodying the present invention, namely, a first embodiment of the present invention.
Figure 6:
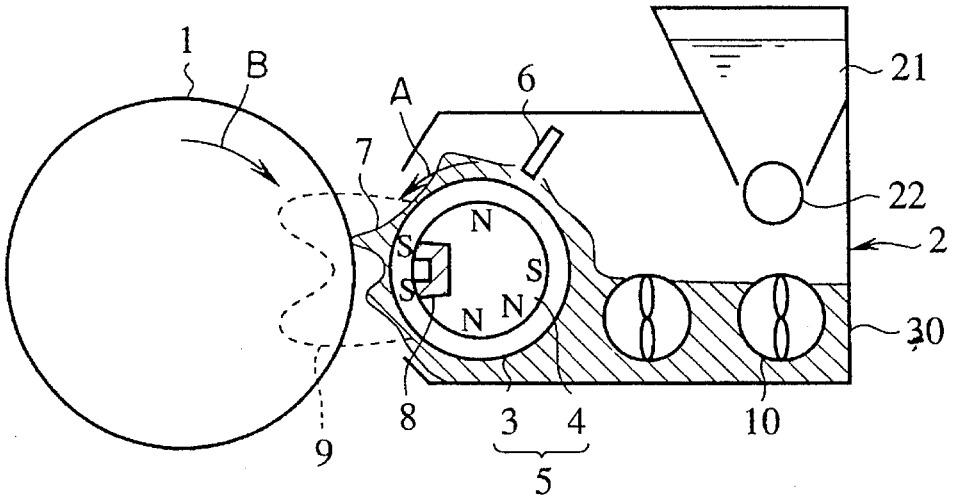
FIG. 6 PRIOR ART
FIG. 6 is a sectional view of a conventional developing apparatus.

The configuration of the entire first embodiment of the present invention is partly similar to that of the aforementioned conventional developing apparatus of FIG. 6. Therefore, the description of composing elements common to the first embodiment and the conventional developing apparatus is omitted herein. Namely, only the difference in configuration between the first embodiment and the conventional developing apparatus will be described hereinafter. A developing roller 5 of this embodiment comprises a sleeve 3 placed therein in such a manner that the axis of rotation thereof is parallel with the axis of rotation of a photo-conductive body 1, and a cylindrical multipole permanent magnet 4 fixedly placed in the sleeve 3 as shown in FIG. 1. Further, a groove is formed in a portion of the multipole permanent magnet 4, which faces the photo-conductive body 1, in such a manner as to extend parallel to the axis of rotation thereof. Moreover, a first magnetic piece 18 and a second magnetic piece 19, which form the double magnetic poles having the same (magnetic) polarity, are embedded in this groove in such a way as to extend parallel to the axis of rotation of the multipole permanent magnet 4 and in parallel with each other. The multipole permanent magnet 4 is usually made of an isotropic magnetic material. Further, the periphery of the magnet 4 is magnetized, so that magnetic poles N1, N2, S3, and N3 are formed in this order in the counterclockwise direction when viewed from the magnetic piece 19, as shown in this figure. The two magnetic pieces 18 and 19 are made of an anisotropic magnetic material or a rare-earth magnetic material. Further, the magnetic pieces 18 and 19 are magnetized in such a manner as to be able to exert magnetic forces stronger than that exerted by the magnet 4, and thus form double magnetic poles S1 and S2 having the same magnetic polarity.

Figure 3:
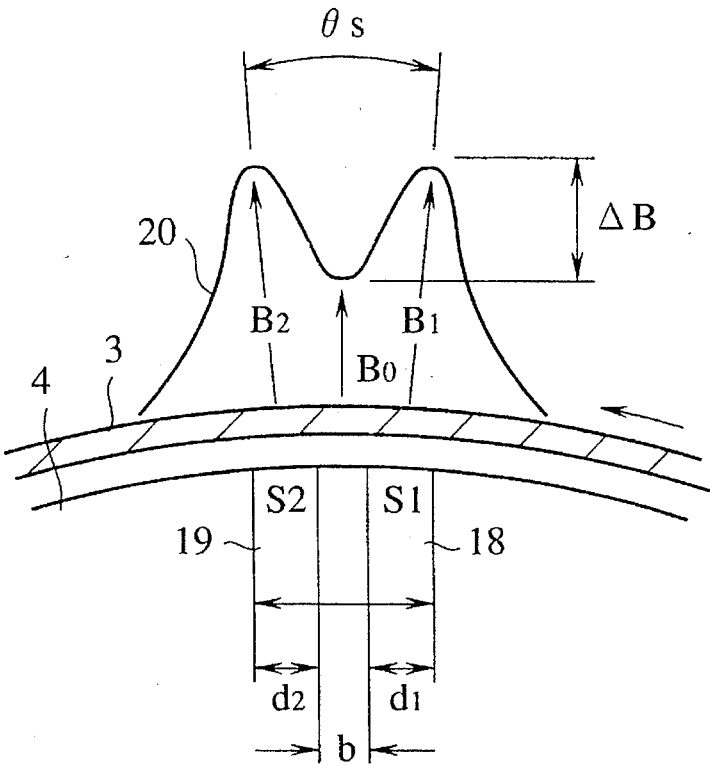
FIG. 3 is a diagram for illustrating the distribution of the magnetic field in the case of the first embodiment of the present invention.

As illustrated in FIG. 3, the gap b between the two magnetic pieces 18 and 19 is set as being within a range of 1 to 8 mm in such a manner that a setting angle θs, which is determined by the first peak of the strength of the magnetic field caused by the first magnetic piece 18 and that of the second peak of the strength of the magnetic field caused by the second magnetic piece 19, ranges from 20 to 40 degrees. Incidentally, the setting angle θs is defined as an angle formed by a line segment connecting the vertex of the first peak of the strength of the magnetic field with the center of rotation of the sleeve 3 and another line segment connecting the vertex of the second peak of the strength of the magnetic field with the center of rotation of the sleeve 3. For example, in the case where θs≈20 degrees, b=0.03 to 0.06 d. Further, in the case where θs≈30 degrees, b=0.08 to 0.13 d. Incidentally, d denotes the diameter of the developing rollers. Moreover, the width in the circumferential direction of each of the two magnetic pieces 18 and 19 is 1 to 5 mm. Furthermore, the value of the second peak of the strength of the magnetic field is 800 to 1300 gausses (G). More preferably, the value of the second peak is 1000 to 1300 G.

Further, the magnetic force exerted by the magnetic pole N1 adjoining the second magnetic piece 19 (namely, the second magnetic pole S2 of the double magnetic poles having the same polarity) downstream in the direction of rotation of the sleeve (namely, in the counterclockwise direction as viewed in this figure) is set as being nearly equal to the magnetic force exerted by the magnetic pole N3 adjoining the first magnetic piece 18 (corresponding to the first magnetic pole S1 of the double magnetic poles having the same polarity) upstream in the direction of rotation of the sleeve (namely, in the clockwise direction as viewed in this figure). Moreover, a developing roller 5 having a diameter of 20 to 50 mm is used in this apparatus. Furthermore, as the developer, a dual component developer containing carrier and toner particles is used therein. As the carrier, resin and ferrite carriers are used. Incidentally, as a resin carrier, spherical or non-spherical resin carrier, which has a bulk specific gravity of 1.0 to 1.6 g/cm$^3$ and a saturation magnetization of 60 to 80 emu/g, is employed. The resin carrier is mixed with the toner at the mixing ratio of 4 to 15 weight percent. In case of ferrite carriers, spherical carriers, which have a bulk specific gravity of 2.2 to 2.7 g/cm$^3$ and a saturation magnetization of 20 to 70 emu/g, are employed. The ferrite carrier is mixed with toner at the mixing ratio of 2 to 5 weight percent.

In the case of the developing apparatus using such a developing roller and setting the regulating gap as being 0.3 to 1.3 mm, it has turned out that the double magnetic poles having the same polarity generate a distribution of magnetic field which has two peaks, as indicated by a solid curve 20 in FIG. 3, and that the double magnetic poles hold the developer 7 and form a first magnetic brush, which has a long "bristle" and is caused by the first magnetic piece 18, and a second magnetic brush, which has a short "bristle" and is caused by the second magnetic piece 19, as illustrated in FIG. 1. Moreover, it has further turned out that a kind of toner cloud is formed in the neighborhood of the second magnetic brush. It is considered that the release of the toner from the carrier is facilitated by the agitation which occurs when the developer 7 held by the first magnetic piece 18 moves in the space between the double magnetic poles having the same polarity, in which there is no constraint on the developer 7 due to the magnetic force, and that thus a kind of toner cloud is formed in the vicinity of the second magnetic brush. As a result, even in a case where the developer 7 held by the second magnetic piece 19 lightly or softly touches the photo-conductive body 1, the latent image can be developed. Namely, when an organic photo-conductive body (OPC) is used as the photo-conductive body 1 and an electrostatic latent image having a contrast electric potential of about 450 V is formed on the photo-conductive body 1, whose circumferential speed is 100 to 300 mm/sec, and the negative development of the latent image is then performed by setting the peripheral speed of the sleeve 3 as being nearly 1 to 2 times the circumferential speed of the photo-conductive body 1, and a developing bias of 250 to 350 V is applied to the sleeve 3, an image density of 1.3 to 1.4 (O.D. (optical density)) can be secured.

Figure 2:
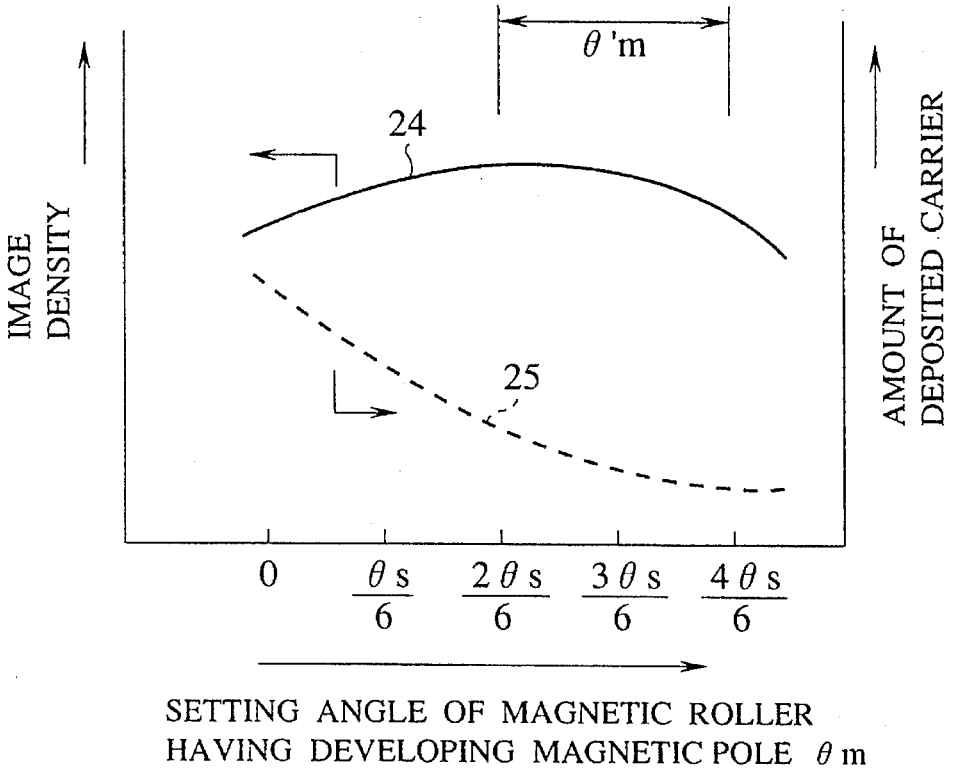
FIG. 2 is a graph illustrating the characteristics which concern the image density and the deposition of carrier particles on a photo-conductive body of the first embodiment of the present invention.

Further, FIG. 2 illustrates the result of an experiment in printing, which is performed by setting the developing gap (namely, the gap between the peripheral surface of sleeve 3 and that of the photo-conductive body 1 at a position where the electrostatic latent image formed on the photo-conductive body 1 is developed) as less than the height of the second magnetic brush above the peripheral surface of the sleeve 3 as shown in FIG. 1 and by changing the position-of-magnetic-pole setting angle θm, namely the angle formed by a half-line radially outwardly extending from the center $C_2$ of the developing roller through the center of the peripheral surface between the double magnetic poles S1 and S2 of same polarity of the multipole permanent magnet 4 and another half-line $C_1$–$C_2$ connecting the center of the developing roller with the center of the photo-conductive body. The experiment was performed keeping the angle between line $C_1$–$C_2$ and horizontal line 5 to 30 degrees. In FIG. 2, solid curve 24 shows the relation between the position-of-magnetic-pole setting angle θm and the image density. Further, dotted line 25 shows the relation between the position-of-magnetic-pole setting angle θm and the amount of deposited carrier. It has turned out that a high-density image can be secured and the deposition of the carrier onto the photo-conductive body 1 can be reduced in the case where the position-of-magnetic-pole setting angle θm is set as being in the range of θs/6 to 5θs/6, more preferably, as shown as θ'm in this figure, the position-of-magnetic-pole setting angle is set as being in the range of 2θs/6 to 4θs/6.

This corresponds to the fact that the second magnetic piece 19 for forming the second peak of the strength of magnetic field is set up at the point where the distance between the photo-conductive body i and the sleeve 3 is almost the smallest. It is considered that in this case, even if the developer 7 softly touches the photo-conductive body 1, the developer can be constrained in a state in which the magnetic force due to the developing roller is large on the surface of the photo-conductive body, because the "bristle" of the magnetic brush formed in the proximity of the second magnetic piece 19 is short or low, and that thus the deposition of the carrier onto the photo-conductive body 1 can be decreased.

Figure 4:
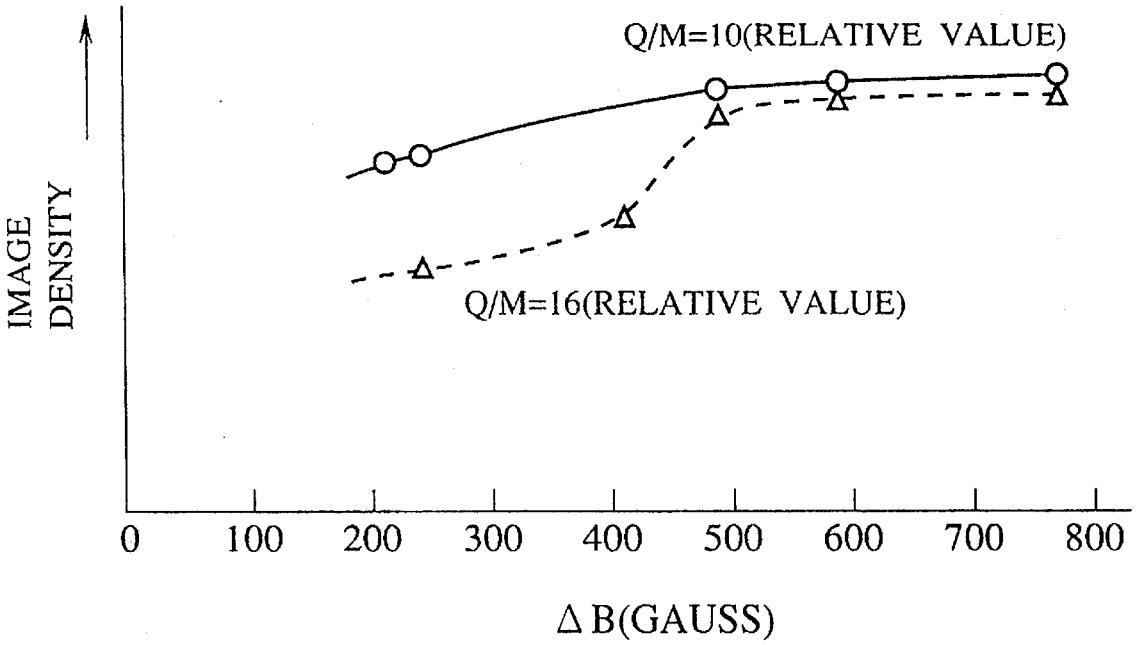
FIG. 4 is a graph illustrating the relation between the image density and ΔB in the case of the first embodiment of the present invention.

Further, according to the result of the experiment, an image having a relatively high density is obtained as illustrated in FIG. 4 in the case where the magnetic force, namely, the strength $B_1$ of the first peak is set as being equal to the strength $B_2$ of the second peak or less than that $B_2$ by 100 to 200 G as occasion demands and further, the difference ΔB between the strength $B_1$ of the first peak and that $B_0$ at the bottom of a valley between the two peaks is set as being in the range of 200 to 800 G. Further, it has turned out that, especially in the case where the difference ΔB is set as being in the range of 450 to 800 G, an image having a high density can be maintained even when the quantity of electric charge (more particularly, the specific charge) Q/M of the toner is increased by about 1.6 times, namely, that the developing apparatus has an advantage in that high-image-quality printing can be stably achieved even when the quantity of electric charge of the toner changes.

(2) Second Embodiment

In the case of a second embodiment, an angle θ1 formed by a half-line extending from the center $C_2$ to the first magnetic pole S1 of the double magnetic poles and another half-line extending from the center $C_2$ to the magnetic pole N3 adjoining the first magnetic pole S1 upstream in the direction of rotation of the sleeve 3 is equal to another angle θ2 formed by a half-line extending from the center $C_2$ to the second magnetic pole S2 of the double magnetic poles and another half-line extending from the center $C_2$ to the magnetic pole N1 adjoining the second magnetic pole S2 downstream in the direction of rotation of the sleeve 3. Moreover, the magnetic force of the magnetic pole N1 is set as being higher than that of the magnetic pole N3 by 50 to 200 G. Namely, the magnetic force of the magnetic pole N3 is set as being in the range of 750 to 800 G, and on the other hand, that of the magnetic pole N1 is set as being in the range of 800 to 1000 G. In this case, the uniformity of the solid image shows a tendency to deteriorate a little in comparison with the first embodiment. This embodiment, however, has an advantage in that the deposition of the carrier onto the photo-conductive body 1, as well as the scatter of the carrier, can be considerably further reduced.

(3) Third Embodiment

Figure 5:
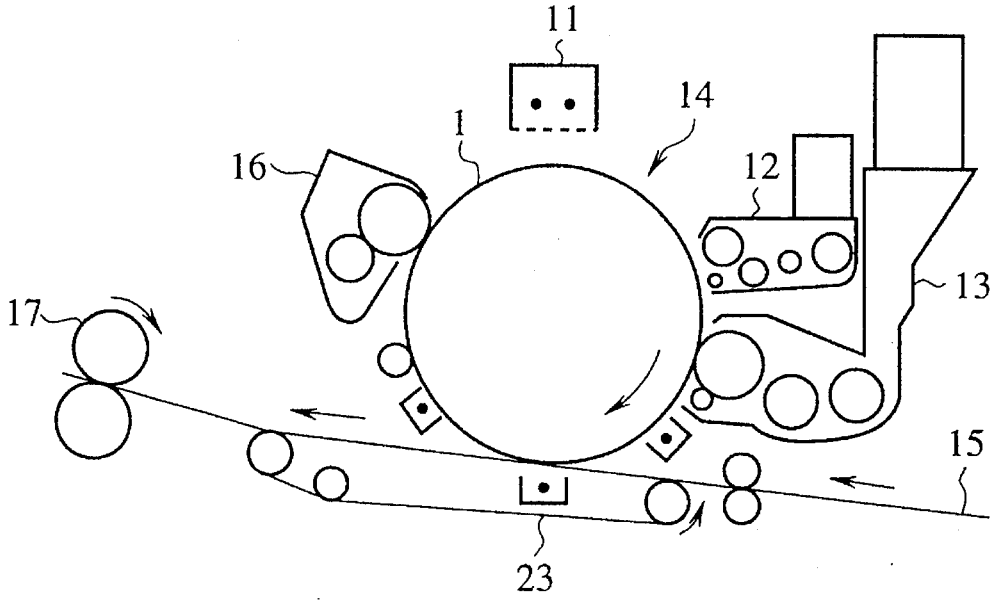
FIG. 5 is a schematic diagram illustrating the configuration of a two-color electrophotographic apparatus embodying the present invention, namely, another embodiment of the present invention.

In the case of the third embodiment of FIG. 5, the developing conditions employed in the aforementioned embodiments are applied to at least a second color developing means or device 13 of an electrophotographic apparatus in which a plurality of developing means or devices 12 and 13, respectively corresponding to different colors, are placed around the photo-conductive body 1, and in which a plurality of latent images respectively corresponding to the colors are formed on the photo-conductive body 1 during a revolution or a plurality of revolutions of the photo-conductive body 1, and moreover, these latent images are developed by the plurality of the developing devices 12 and 13, respectively, to thereby form a multicolor toner image on the photo-conductive body 1 and transfer the multicolor toner image onto recording paper 15 in one transferring operation. Each of such developing means or devices has a configuration obtained by removing the photo-conductive body 1 and means for developing an electrostatic latent image on the photo-conductive body 1 from the composing elements of the developing apparatus of the first embodiment. Incidentally, the aforementioned developing conditions are requirements for the configuration of the developing roller and for the relative positional relation between the developing roller and the photo-conductive body.

Further, in the case where a multicolor toner image is formed on the photo-conductive body 1 by a plurality of revolutions of the photo-conductive body, the apparatus of the third embodiment has a mechanism by which the first color developing device 12, the second color developing device 13, a transferring means or device 23 and a cleaning means or device 16 can make contact with and move away from the photo-conductive body 1. Namely, at a first rotation of the photo-conductive body 1, the second color developing device 13, the transferring device 23 and the cleaning device 16 move away from the photo-conductive body 1 but the first color developing device 12 makes contact therewith. Further, at a second rotation of the photo-conductive body 1, the first color developing device 12 moves away from the photo-conductive body 1, while the second color developing device 13, the transferring device 23 and the cleaning device 16 make contact therewith.

When two-color toner image is formed on the photo-conductive body 1 so as to perform a two-color printing, the dual component developer consisting of the carrier and the toner is used in the second color developing device 13. Further, in the case where resin carrier, whose saturation magnetization is 60 to 80 emu/g, or ferrite carrier, whose saturation magnetization is 20 to 70 emu/g, is employed as the contained carrier, and the circumferential speed of the sleeve 3 is set as being 0.9 to 1.4 times the circumferential speed of the photo-conductive body and the difference between the regulating gap and the developing gap is set as being 0.1 to 0.4 mm (and developing gap is wider), the toner image formed in the preceding stage is not disturbed. Moreover, the image density of the second color can be secured. Furthermore, the carrier can be prevented from depositing onto the photo-conductive body 1 when developing the image of the second color.

Further, in the case where color developer is used in the first color developing device 12 and the developing conditions according to the present invention are applied thereto, the sliding friction force between the developer magnetic brush of the first color developing device 12 and the photo-conductive body 1 can be reduced, because the developer in this first color developing device lightly or softly touches the photo-conductive body 1. Thus, the apparatus of this embodiment has the advantages that even if the toner has not been eliminated perfectly in the preceding cleaning step, the rate of the scraping away of the toner remaining on the photo-conductive body 1 can be decreased, and that the mixing of the toner into the first color developing device can be prevented, or the toner mixed into the first color developing device can be reduced considerably.

Incidentally, the present invention can be applied to a color electrophotographic apparatus of the type that forms a multicolor image during one revolution of the photo-conductive body.

In accordance with the present invention, the magnetic force due to the second magnetic pole of the double magnetic poles which is exerted on the surface of the photo-conductive body can be enhanced, and the carrier can be constrained on the sleeve by setting the second magnetic pole thereof at the point where the distance between the photo-conductive body and the sleeve is almost smallest. Thereby, the carrier does not deposit on the photo-conductive body at all.

Moreover, in the case of the apparatus of the present invention, a toner cloud is formed in the vicinity of the second magnetic pole of the double magnetic poles of the same polarity by the agitation which occurs when the developer held by the first magnetic pole thereof moves in a space between the first and second magnetic poles thereof as the sleeve rotates. Therefore, the image density can be secured even when a latent image is developed by bringing the developer into light or soft contact with the photo-conductive body.

Furthermore, in the case of the apparatus of the present invention, when toner images of a plurality of colors are formed on the photo-conductive body and color printing is performed, the toner images formed in the preceding stage are not disturbed at all. Additionally, the image densities respectively corresponding to the second and subsequent colors can be secured. Further, when developing the image correspondingly to each of the second and subsequent colors, the carrier can be prevented from depositing on the photo-conductive body.

Although the preferred embodiments of the present invention have been described above, it should be understood that the present invention is not limited thereto, and that other modifications will be apparent to those skilled in the art without departing from the spirit of the invention.

The scope of the present invention, therefore, is to be determined solely by the appended claims.

What is claimed is:

1. A developing apparatus for an electrophotographic system, said developing apparatus comprising:

a rotatable sleeve;

a stationary multipole permanent magnet positioned within said rotatable sleeve;

a photo-conductive body having an axis of rotation parallel with the axis of rotation of said rotatable sleeve;

means for forming an electrostatic latent image on a surface of said photo-conductive body;

means for supplying to the peripheral surface of said rotatable sleeve a developer containing at least carrier and toner and adapted to be attracted onto and held on said peripheral surface of said rotatable sleeve by magnetic force of said multipole permanent magnet; and first and second magnetic pieces positioned in said multipole permanent magnet in a region facing said photo-conductive body and adjoining said peripheral surface of said rotatable sleeve, each of said first and second magnetic pieces being elongated in a direction parallel to the axis of rotation of said rotatable sleeve, said first and second magnetic pieces having the same magnetic polarity, so that said first and second magnetic pieces cause respective first and second peaks of magnetic field strength in a section perpendicular to the axis of rotation of said rotatable sleeve, wherein an angle θm formed by a first line extending radially from the axis of rotation of said rotatable sleeve and midway between said first and second magnetic pieces and a second line extending between the axis of rotation of said rotatable sleeve and the axis of rotation of said photo-conductive body is between ⅔ and ⅘ of an angle θs formed by a third line extending between the vertex of the first peak and the axis of rotation of said rotatable sleeve and a fourth line extending between the vertex of the second peak and the axis of rotation of said rotatable sleeve, so that the developer held on said peripheral surface of said rotatable sleeve is brought by rotation of said rotatable sleeve into contact with the peripheral surface of said photo-conductive body, thereby developing an electrostatic latent image on said peripheral surface of said photo-conductive body.

2. The developing apparatus according to claim 1, wherein said first and second magnetic pieces cause the difference between the magnetic field strength at the first peak and the magnetic field strength at the bottom of the valley between the first and second peaks to be in the range of 450 to 800 G.

3. A developing apparatus for use in an electrophotographic system, said developing apparatus comprising:

a rotatable sleeve;

a stationary multipole permanent magnet positioned within said rotatable sleeve;

a cylindrical photo-conductive body having an axis of rotation parallel to the axis of rotation of said rotatable sleeve;

means for forming an electrostatic latent image on a surface of said photo-conductive body;

means for supplying to the peripheral surface of said rotatable sleeve a developer containing at least carrier and toner; and first and second magnetic pieces positioned in said multipole permanent magnet in a region facing said photo-conductive body and adjoining said peripheral surface of said rotatable sleeve, thereby forming a magnetic field having first and second peaks of magnetic field strength, each of said first and second magnetic pieces being elongated in a direction parallel to the axis of rotation of said rotatable sleeve, said first and second magnetic pieces having the same magnetic polarity, wherein:

the second peak is located downstream of the first peak in the direction of rotation of the sleeve and at almost the closest point between said photo-conductive body and said rotatable sleeve, said first and second magnetic pieces are spaced apart a distance in the range of 1 to 8 mm; and an angle θs, formed by a first line extending between the vertex of the first peak and the axis of rotation of said rotatable sleeve and a second line extending between the vertex of the second peak and the axis of rotation of said rotatable sleeve, is in the range of 20 to 40 degrees.

4. A developing apparatus for use in an electrophotographic system, said developing apparatus comprising:

a rotatable sleeve;

a stationary multipole permanent magnet positioned within said rotatable sleeve;

a photo-conductive body having an axis of rotation parallel with the axis of rotation of said rotatable sleeve;

means for forming an electrostatic latent image on a surface of said photo-conductive body;

means for supplying to a peripheral surface of said rotatable sleeve a developer containing at least carrier and toner and adapted to be attracted onto and held on said peripheral surface of said rotatable sleeve by magnetic force of said multipole permanent magnet; and first and second magnetic pieces positioned in said multipole permanent magnet in a region facing said photo-conductive body and adjoining said peripheral surface of said rotatable sleeve, each of said first and second magnetic pieces being elongated in a direction parallel to the axis of rotation of said rotatable sleeve, said first and second magnetic pieces having same magnetic polarity, wherein:

the first and second magnetic pieces cause respective first and second peaks of magnetic field strength in a section perpendicular to the axis of rotation of said rotatable sleeve;

said second magnetic piece is positioned downstream from said first magnetic piece in the direction of rotation of said rotatable sleeve such that the second peak is formed at a point at which the distance between said photo-conductive body and said rotatable sleeve is substantially the smallest, such that developer held on said peripheral surface of said rotatable sleeve is brought by rotation of said rotatable sleeve into contact with the peripheral surface of said photo-conductive body, thereby developing an electrostatic latent image on said peripheral surface of said photo-conductive body;

said first and second magnetic pieces are spaced apart by a distance in the range of 1 to 8 mm; and the angle θs formed by a first line extending between the vertex of the first peak and the axis of rotation of said rotatable sleeve and a second line extending between the vertex of the second peak and the axis of rotation of said rotatable sleeve, is in the range of 20 to 40 degrees.

5. A developing apparatus for use in an electrophotographic system, said developing apparatus comprising:

a rotatable sleeve;

a stationary multipole permanent magnet positioned within said rotatable sleeve;

a cylindrical photo-conductive body having an axis of rotation parallel to the axis of rotation of said rotatable sleeve;

means for forming an electrostatic latent image on a surface of said photo-conductive body;

means for supplying to the peripheral surface of said rotatable sleeve a developer containing at least carrier and toner; and first and second magnetic pieces positioned in said multipole permanent magnet in a region facing said photo-conductive body and adjoining said peripheral surface of said rotatable sleeve, thereby forming a magnetic field having first and second peaks of magnetic field strength, each of said first and second magnetic pieces being elongated in a direction parallel to the axis of rotation of said rotatable sleeve, said first and second magnetic pieces having the same magnetic polarity, wherein:

the second peak is located downstream of the first peak in the direction of rotation of the sleeve and at almost the closest point between said photo-conductive body and said rotatable sleeve; and said first and second magnetic pieces cause the magnetic field strength at the second peak to be in the range of 1000 to 1300 G.

6. A developing apparatus for use in an electrophotographic system, said developing apparatus comprising:

a rotatable sleeve;

a stationary multipole permanent magnet positioned within said rotatable sleeve;

a photo-conductive body having an axis of rotation parallel with the axis of rotation of said rotatable sleeve;

means for forming an electrostatic latent image on a surface of said photo-conductive body;

means for supplying to a peripheral surface of said rotatable sleeve a developer containing at least carrier and toner and adapted to be attracted onto and held on said peripheral surface of said rotatable sleeve by magnetic force of said multipole permanent magnet; and first and second magnetic pieces positioned in said multipole permanent magnet in a region facing said photo-conductive body and adjoining said peripheral surface of said rotatable sleeve, each of said first and second magnetic pieces being elongated in a direction parallel to the axis of rotation of said rotatable sleeve, said first and second magnetic pieces having same magnetic polarity, wherein:

the first and second magnetic pieces cause respective first and second peaks of magnetic field strength in a section perpendicular to the axis of rotation of said rotatable sleeve;

said second magnetic piece is positioned downstream from said first magnetic piece in the direction of rotation of said rotatable sleeve such that the second peak is formed at a point at which the distance between said photo-conductive body and said rotatable sleeve is substantially the smallest, such that developer held on said peripheral surface of said rotatable sleeve is brought by rotation of said rotatable sleeve into contact with the peripheral surface of said photo-conductive body, thereby developing an electrostatic latent image on said peripheral surface of said photo-conductive body; and said first and second magnetic pieces cause the magnetic field strength at the second peak to be in the range of 1000 to 1300 G.

7. The developing apparatus according to claim 1, wherein said developer supplying means contains a developer containing resin carrier, the saturation magnetization of which is 60 to 80 emu/g, and a toner.

8. The developing apparatus according to claim 1, wherein said developer supplying means contains a developer containing ferrite carrier, the saturation magnetization of which is 20 to 70 emu/g, and a toner.

9. The developing apparatus according to claim 1, wherein;

said multipole permanent magnet includes a first part upstream from said first magnetic piece in the direction of rotation of said rotatable sleeve and a second part downstream from said second magnetic piece in the direction of rotation of said rotatable sleeve;

said first part and said second part are magnetized so as to have a magnetic polarity different from the magnetic polarity of said first and second magnetic pieces; and the magnetic field strength due to said second part is greater than the magnetic field strength due to said first part.

10. A color electrophotographic system comprising:

a rotatable photo-conductive body having a surface adapted for forming thereon of a plurality of latent images during one or a plurality of revolutions thereof, the latent images corresponding respectively to a plurality of colors;

means for forming the plurality of latent images on said surface of said photo-conductive body; and a plurality of developing apparatuses positioned around said photo-conductive body, for forming toner images respectively corresponding to the colors of the latent images on the photo-conductive body, each of said developing apparatus being adapted to contain a developer of a corresponding one of the colors and including at least carrier and toner, and to develop the latent image of the corresponding one of the colors, at least the developing apparatus corresponding to the second one of the colors comprising:

a rotatable sleeve having an axis of rotation parallel to the axis of rotation of said rotatable photo-conductive body;

a stationary multipole permanent magnet positioned within said rotatable sleeve;

means for supplying to the peripheral surface of said rotatable sleeve the developer of the corresponding color, the developer of the corresponding color being adapted to be attracted onto and held on said peripheral surface of said rotatable sleeve by magnetic force of said multipole permanent magnet; and first and second magnetic pieces positioned in said multipole permanent magnet in a region facing said photo-conductive body and adjoining said peripheral surface of said rotatable sleeve, each of said first and second magnetic pieces being elongated in a direction parallel to the axis of rotation of said rotatable sleeve, said first and second magnetic pieces having the same magnetic polarity, so that said first and second magnetic pieces cause respective first and second peaks of magnetic field strength in a section perpendicular to the axis of rotation of said rotatable sleeve, wherein an angle $\theta m$ formed by a first line extending radially from the axis of rotation of said rotatable sleeve and midway between said first and second magnetic pieces and a second line extending between the axis of rotation of said rotatable sleeve and the axis of rotation of said photo-conductive body is between 2/6 and 4/6 of an angle θs formed by a third line extending between the vertex of the first peak and the axis of rotation of said rotatable sleeve and a fourth line extending between the vertex of the second peak and the axis of rotation of said rotatable sleeve, so that the developer held on said peripheral surface of said rotatable sleeve is brought by rotation of said rotatable sleeve into contact with the peripheral surface of said photo-conductive body, thereby developing an electrostatic latent image on said peripheral surface of said photo-conductive body.

11. The color electrophotographic system according to claim 10, wherein said first and second magnetic pieces cause a difference between the magnetic field strength at the first peak and the magnetic field strength at the bottom of a valley between the first and second peaks to be in the range of 450 to 800 G.

12. A color electrophotographic system comprising:

a rotatable photo-conductive body having a surface adapted for forming thereon of a plurality of latent images during one or a plurality of revolutions thereof, the latent images corresponding respectively to a plurality of colors;

means for forming the plurality of latent images on said surface of said photo-conductive body; and a plurality of developing apparatuses positioned around said photo-conductive body, for forming toner images respectively corresponding to the colors of the latent images on the photo-conductive body, each of said developing apparatus being adapted to contain a developer of a corresponding one of the colors and including at least carrier and toner, and to develop the latent image of the corresponding one of the colors, at least the developing apparatus corresponding to the second one of the colors comprising:

a rotatable sleeve having an axis of rotation parallel to the axis of rotation of said rotatable photo-conductive body;

a stationary multipole permanent magnet positioned within said rotatable sleeve;

means for supplying to a peripheral surface of said rotatable sleeve the developer of the corresponding color, and first and second magnetic pieces positioned in said multipole permanent magnet in a region facing said photo-conductive body and adjoining said periphery surface of said rotatable sleeve, thereby forming a magnetic field having first and second peaks of magnetic field strength, each of said first and second magnetic pieces being elongated in a direction parallel to the axis of rotation of said rotatable sleeve, said first and second magnetic pieces having the same magnetic polarity, wherein:

the second peak is located downstream of the first peak in the direction of rotation of the sleeve and at almost the closest point between said photo-conductive body and said rotatable sleeve;

said first and second magnetic pieces are spaced apart by a distance in the range of 1 to 8 mm; and an angle θs, formed by a first line extending between the vertex of the first peak and the axis of rotation of said rotatable sleeve and a second line extending between the vertex of the second peak and the axis of rotation of said rotatable sleeve, is in the range of 20 to 40 degrees.

13. A color electrophotographic system comprising:

a rotatable photo-conductive body having a surface adapted for forming thereon of a plurality of latent images during one or a plurality of revolutions thereof, the latent images corresponding respectively to a plurality of colors;

means for forming the plurality of latent images on said surface of said photo-conductive body; and a plurality of developing apparatuses positioned around said photo-conductive body, for forming toner images respectively corresponding to the colors of the latent images on the photo-conductive body, each of said developing apparatus being adapted to contain a developer of a corresponding one of the colors and including at least carrier and toner, and to develop the latent image of the corresponding one of the colors, at least the developing apparatus corresponding to the second One of the colors comprising:

a rotatable sleeve having an axis of rotation parallel to the axis of rotation of said rotatable photo-conductive body;

a stationary multipole permanent magnet positioned within said rotatable sleeve;

means for supplying to the peripheral surface of said rotatable sleeve the developer of the corresponding color, the developer of the corresponding color being adapted to be attracted onto and held on said peripheral surface of said rotatable sleeve by magnetic force of said multipole permanent magnet; and first and second magnetic pieces positioned in said multipole permanent magnet in a region facing said photo-conductive body and adjoining said peripheral surface of said rotatable sleeve, each of said first and second magnetic pieces being elongated in a direction parallel to the axis of rotation of said rotatable sleeve, said first and second magnetic pieces having the same magnetic polarity, so that said first and second magnetic pieces cause respective first and second peaks of magnetic field strength in the section perpendicular to the axis of rotation of said rotatable sleeve, wherein:

said second magnetic piece is positioned downstream from said first magnetic piece in the direction of rotation of said rotatable sleeve such that the second peak is formed at a point at which the distance between said photo-conductive body and said rotatable sleeve is substantially the smallest, such that developer held on said peripheral surface of said rotatable sleeve is brought by rotation of said rotatable sleeve into contact with the peripheral surface of said photo-conductive body, thereby developing an electrostatic image on said peripheral surface of said photo-conductive body;

said first and second magnetic pieces are spaced apart by a distance in the range of 1 to 8 mm; and an angle θs, formed by a first line extending between the vertex of the first peak and the axis of rotation of said rotatable sleeve and a second line extending between the vertex of the second peak and the axis of rotation of said rotatable sleeve, is in the range of 20 to 40 degrees.

14. A color electrophotographic system comprising:

a rotatable photo-conductive body having a surface adapted for forming thereon of a plurality of latent images during one or a plurality of revolutions thereof, the latent images corresponding respectively to a plurality of colors;

means for forming the plurality of latent images on said surface of said photo-conductive body; and a plurality of developing apparatuses positioned around said photo-conductive body, for forming toner images respectively corresponding to the colors of the latent images on the photo-conductive body, each of said developing apparatus being adapted to contain a developer of a corresponding one of the colors and including at least carrier and toner, and to develop the latent image of the corresponding one of the colors, at least the developing apparatus corresponding to the second one of the colors comprising:

a rotatable sleeve having an axis of rotation parallel to the axis of rotation of said rotatable photo-conductive body;

a stationary multipole permanent magnet positioned within said rotatable sleeve;

means for supplying to a peripheral surface of said rotatable sleeve the developer of the corresponding color; and first and second magnetic pieces positioned in said multipole permanent magnet in a region facing said photo-conductive body and adjoining said periphery surface of said rotatable sleeve, thereby forming a magnetic field having first and second peaks of magnetic field strength, each of said first and second magnetic pieces being elongated in a direction parallel to the axis of rotation of said rotatable sleeve, said first and second magnetic pieces having the same magnetic polarity, wherein:

the second peak is located downstream of the first peak in the direction of rotation of the sleeve and at almost the closest point between said photo-conductive body and said rotatable sleeve; and said first and second magnetic pieces cause the magnetic field strength at the second peak to be in the range of 1000 to 1300 G.

15. A color electrophotographic system comprising:

a rotatable photo-conductive body having a surface adapted for forming thereon of a plurality of latent images during one or a plurality of revolutions thereof, the latent images corresponding respectively to a plurality of colors;

means for forming the plurality of latent images on said surface of said photo-conductive body; and a plurality of developing apparatuses positioned around said photo-conductive body, for forming toner images respectively corresponding to the colors of the latent images on the photo-conductive body, each of said developing apparatus being adapted to .contain a developer of a corresponding one of the colors and including at least carrier and toner, and to develop the latent image of the corresponding one of the colors, at least the developing apparatus corresponding to the second one of the colors comprising:

a rotatable sleeve having an axis of rotation parallel to the axis of rotation of said rotatable photo-conductive body;

a stationary multipole permanent magnet positioned within said rotatable sleeve;

means for supplying to the peripheral surface of said rotatable sleeve the developer of the corresponding color; and first and second magnetic pieces positioned in said multipole permanent magnet in a region facing said photo-conductive body and adjoining said peripheral surface of said rotatable sleeve, each of said first and second magnetic pieces being elongated in a direction parallel to the axis of rotation of said rotatable sleeve, said first and second magnetic pieces having the same magnetic polarity, so that said first and second magnetic pieces cause respective first and second peaks of magnetic field strength in the section perpendicular to the axis of rotation of said rotatable sleeve, wherein:

said second magnetic piece is positioned downstream from said first magnetic piece in the direction of rotation of said rotatable sleeve such that the second peak is formed at a point at which the distance between said photo-conductive body and said rotatable sleeve is substantially the smallest, such that developer held on said peripheral surface of said rotatable sleeve is brought by rotation of said rotatable sleeve into contact with the peripheral surface of said photo-conductive body, thereby developing an electrostatic image on said peripheral surface of said photo-conductive body; and said first and second magnetic pieces cause the magnetic field strength at the second peak to be in the range of 1000 to 1300 G.

16. The color electrophotographic system according to claim 10, wherein said developer supplying means contains a developer containing resin carrier, the saturation magnetization of which is 60 to 80 emu/g, and a toner.

17. The color electrophotographic system according to claim 10, wherein said developer supplying means contains a developer containing ferrite carrier, the saturation magnetization of which is 20 to 70 emu/g, and a toner.

18. The color electrophotographic system according to claim 10, wherein said multiple permanent magnet includes a first part upstream from said first magnetic piece in the direction of rotation of said rotatable sleeve and a second part downstream from said second magnetic piece in the direction of rotation of said rotatable sleeve;

said first part and said second part are magnetized so as to have a magnetic polarity different from the magnetic polarity of said first and second magnetic pieces; and the magnetic field strength due to said second part is greater than the magnetic field strength due to said first part.

19. The developing apparatus according to claim 1, wherein said first and second magnetic pieces are spaced apart by a distance in the range of 1 to 8 mm, and the angle θs is in the range of 20 to 40 degrees.

20. The developing apparatus according to claim 1, wherein said first and second magnetic pieces cause the magnetic field strength at the second peak to be in the range of 1000 to 1300 G.

21. The color electrophotographic system according to claim 10, wherein said first and second magnetic pieces are spaced apart by a distance in the range of 1 to 8 mm, and angle θs is in the range of 20 to 40 degrees.

22. The color electrophotographic system according to claim 10, wherein said first and second magnetic pieces cause the magnetic field strength at the second peak to be in the range of 1000 to 1300 G.

* * * * *